United States Patent [19]

Uchin

[11] 4,127,223

[45] Nov. 28, 1978

[54] STRAP CARRYING DEVICE

[76] Inventor: Stanley P. Uchin, 21 Alexander Rd., E. Brunswick, N.J. 08816

[21] Appl. No.: 844,743

[22] Filed: Oct. 25, 1977

[51] Int. Cl.[2] ..... B65D 71/00

[52] U.S. Cl. ..... 224/55; 190/59

[58] Field of Search ..... 224/55, 53, 47, 58, 224/46 R, 45 N, 5 N, 26 R, 5 Q, 5 R; 190/55 R, 59, 57, 58 A, 27; 150/12

[56] References Cited

U.S. PATENT DOCUMENTS

| | | | |
|---|---|---|---|
| 1,082,017 | 12/1913 | Feinen | 224/55 |
| 1,273,201 | 7/1918 | Teuber | 224/5 N |
| 1,742,822 | 1/1930 | Olson | 297/255 |
| 1,847,501 | 3/1932 | Stahler | 224/55 |
| 2,416,602 | 2/1947 | Wilson et al. | 224/53 |
| 3,682,358 | 8/1972 | Richey | 224/5 R |
| 3,690,525 | 9/1972 | Keons | 224/9 |
| 3,820,695 | 6/1974 | Pecjak | 224/55 |
| 3,918,618 | 11/1975 | Castaneda | 224/55 |
| 3,920,211 | 11/1975 | Knight | 248/311 |

FOREIGN PATENT DOCUMENTS

| | | | |
|---|---|---|---|
| 717,019 | 12/1931 | France | 224/53 |
| 963,214 | 3/1948 | France | 224/55 |

*Primary Examiner*—Trygve M. Blix
*Assistant Examiner*—Kenneth Noland

[57] ABSTRACT

In a preferred embodiment, an attache-type case is transported within a luggage-harness and attached shoulder strap, the luggage harness being straps enveloping sides and bottom of the attache-type case, the luggage-harness including a horizontal circumscribing strap having a detachably-fastened latch at one side thereof for easy access thereinto, and the luggage-harness including a bottom strap for supporting the underedge of the case and continuing uprightly at each of opposite ends thereof and crossing and interconnecting with the circumscribing strap at spaced-apart points adapted to place the center of gravity centrally of the length of the bottom strap, with the circumscribing strap and the upright ends being adjustably interconnected for horizontal adjustment at one end and for vertical adjustment at the opposite end such that depth and breadth-length of the case-carrying space are variably adjustable, the horizontal circumscribing strap being at a height avoiding tilting and avoiding slipping-over the top of the case.

4 Claims, 5 Drawing Figures

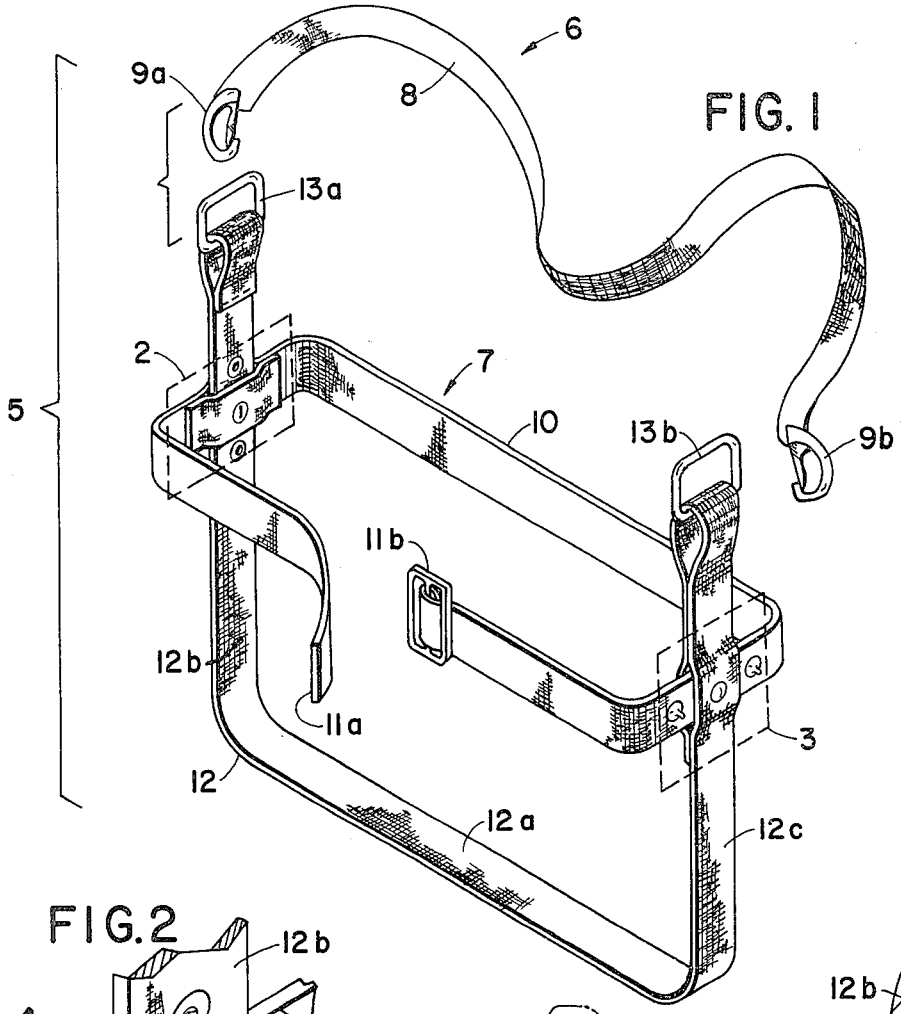
FIG. 1
FIG. 2
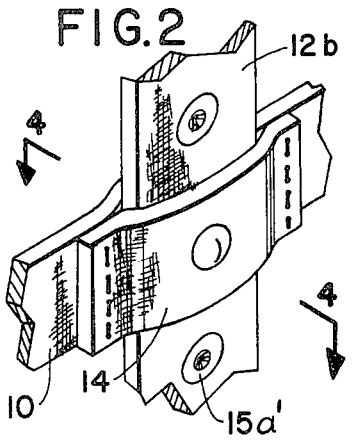
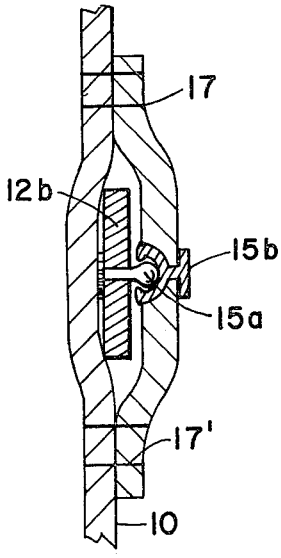
FIG. 4
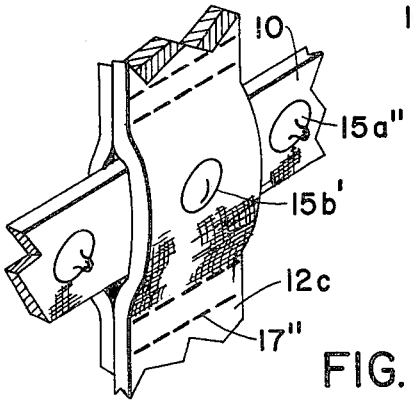
FIG. 3
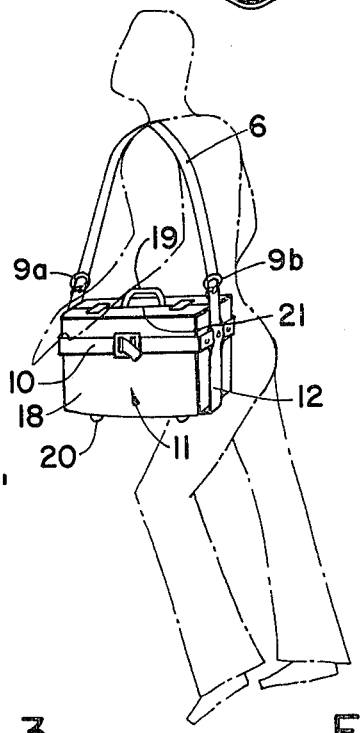
FIG. 5

STRAP CARRYING DEVICE

This invention relates to a carrying-harness and shoulder strap for attache-case type luggage.

BACKGROUND TO THE INVENTION

Heretofore there has existed shoulder-carried bags such as duffle bags and some womens pocket books. There have also existed wheeled stands for the carrying of large bulky bags or luggage not readily carried by a frail person over extended distances. However, there has not existed any suitable apparatus for the carrying over the shoulder of a normally hand-carried bag or luggage of the attache type, while there has existed a need particularly for salesmen, to free both hands for the carrying of other merchandise, articles or the like. Moreover, typically it would seem counter-productive to have to carry a carrying case in which to transport another case.

SUMMARY OF THE INVENTION

Accordingly, objects of the present invention include the obtaining of an attache-type luggage-carrying device which avoids difficulties and disadvantages noted above, together with other novel advantages.

Another object is to obtain an attache case carrying device suitable for transport by shoulder-support, including proper balance and trim during the transport.

Another object is to obtain an attache case carrying device suitable for freeing both hands while providing sturdy and secure support for the carried-attache case.

Another object is to obtain an attache case carrying device providing easy access for the insertion and removal thereof of the case.

Another object is to obtain an attache case carrying device providing easily adjustable mechanism by simple and inexpensive structure, for varying breadth and/or length and/or depth of luggage-carrying space within the device.

Another object is to obtain an attache case carrying device providing for centering a bottom-support intermmediate of a width of the carried case and/or providing for centerof gravity centrally between opposite strap-carrying ends thereof.

Another object is to obtain an attache case carrying device of a collapsible and compactable nature easily transportable in a compact space.

Another object is to obtain an attache case carrying device adapted to prevent accidental opening and spilling of contents of a transported attache case during transport.

Another object is to obtain an attache case carrying device having easy-access latching mechanism for quick packing and/or removal of the case.

Other objects become apparent from the preceding and following disclosures.

One or more of the preceding objects are obtained by the invention as illustrated in the following illustrations which are not intended to limit the scope of the invention but to merely facilitate an understanding thereof, and to identify preferred features thereof.

Broadly the invention may be described as a luggage-harnes combination including harness structures enveloping of the sides and bottom of a luggage piece such as an attache case, together with spaced-apart opposite ends thereof having attached thereof opposite ends of a shoulder-strap type device, adapted such that an attache case or the like may be thusly transported by shoulder support thereof.

In a preferred embodiment thereof the harness structures include a plurality of elongated cord elements interconnected with one-another. One of the cord elements is a horizontal circumscribing cord, and another of the cord elements is a cord having a horizontal bottom and continuous with, at opposite ends thereof, vertical-ends and is positioned such that the horizontal bottom-portion and vertical-ends are centered relative to hand luggage carried therein; the horizontal bottom and continuous vertical-ends are also adapted such that center of gravity of luggage carried therein is substantially equally-spaced between said spaced-apart vertical-ends and latching mechanisms carried at upper ends thereof for the attaching detachably of the shoulder strap, preferably the shoulder strap being detachably latched at opposite ends of the shoulder strap.

In a further preferred embodiment, at oppositely spaced-apart points, the respective vertical-ends above-noted are interconnected with the horizontal circumscribing cord at preferably about mid-height intermediate points between the horizontal bottom-portion cord and the latching mechanisms. Typically and preferably the cords are one or more of heavy and durable fabric, but may be of leather, vinyl material, weaves or other conventional and available material(s). Likewise, the latching mechanism may be any suitable buckle, hook, snap, velcro or other device. Inter-connection is preferably above mid-height.

In a preferred other embodiment, the connections of the vertical ends with the horizontal circumscribing cord are adjustable, and more preferably one end being adjustable of depth of the luggage-carrying space, and the other one being adjustable of thickness and/or length of the luggage-carrying space.

In a further preferred embodiment, the latching mechanisms are sufficiently highly positioned as to avoid the possibility of scarring of upper portions of an attache case being transported within the enveloping cords supported by the shoulder strap.

In a further preferred embodiment, the horizontal circumscribing cord includes at preferably a broad side position of a transported case, detachable fastening mechanism, adapted such that the horizontal-circumscribing cord may be opened to quickly receive or to remove hand luggage therefrom conveniently.

Preferably the horizontal circumscribing cord is sufficiently highly positioned with regard to connections with the vertical-ends for improved balance against tipping, and such that an attache case is held in a securely closed state secure against opening by virture of being bound closed, preventing accidental opening of the case if bounced-around, or laid-down and lifted with a jerk, or the like.

The invention may be better understood by making reference to the following Figures.

THE FIGURES FIG. 1 illustrates a preferred embodiment of the luggage-harness above-described, shown in exploded view in a perspective view thereof in an unlatched state of the horizontal circumscribing cord. FIG. 2 illustrates an enlarged portion 2 of the FIG. 1 illustration, in side perspective view. FIG. 3 illustrates an enlarged portion 3 of FIG. 1 illustration, in side perspective view. FIG. 4 illustrates a cross-sectional view of the embodiment of FIG. 2 as taken along line 4—4 thereof. FIG. 5 illustrates, relative to a person shown in phantom, the attache case being carried within the luggage-harness as supported on the shoulder of the person by the supporting strap, shown in a perspective side view.

DETAILED DESCRIPTION OF THE INVENTION

More particularly, with reference to the above FIGS. 1 through 5 which all disclose a common preferred luggage-harness 5, and strap 6, as shown in complete view in Figures 1 and 5, the FIGS. 2, 3 and 4 disclose more particular features thereof. Accordingly, hereinafter specific reference normally shall not be made to any particular one of the Figures.

The strap 6 has snap ring 9*a* at one end thereof, and snap ring 9*b* at the other end thereof, for latching by snap-actions thereof onto the rings 13*a* and 13*b* located at the upper ends of the vertical ends 12*b* and 12*c* which vertical ends are inter-connected in series by the horizontal bottom cord 12*a*. Accordingly, the harness 7 of FIGS. 1 and 5 is transportable of an attache case 18 preferably positioned with the hinges 20 in the illustrated downward direction, the horizontal circumscribing cord 10 being positioned at a sufficiently high level as to prevent accidental opening of the attache case as well as to provide lateral support preventing tipping-over, and the rings 13*a* and 13*b* being sufficiently elevated above the attache top 21 as to prevent marring of the top 21. The connection of portion 2 as illustrated in FIG. 2 has the cord 12*b* as rings 13*a* and 13*b* being sufficiently elevated above the attache top 21 as to prevent marring of the top 21. The connection of portion 2 as illustrated in FIG. 2 has the cord 12*b* as the through-member passing through a loop 14, and having a male snap element 15*a* snapped into a female snap element 15*b*, to maintain desired position; there are alternate male snap elements such as snap element 15*a*'; by slipping the cord downwardly, the cord 12*a* thereby has greater depth. By slipping the through-cord 10*b* through the loop of portion 3 of FIG. 3, the space provided for either case width and/or length from end-to-end thereof, may be altered to greater or lesser, depending upon which way it is slipped. A snap such as 15*a*'' snaps into the female receptacle of a female element 15*b*' (the back side thereof being illustrated). Loop-forming threads 17 and 17' and 17'' are typically illustrated.

The tightness of the circumscribing horizontal cord and the fastening and unfastening are controlled by the belt-end 11*a* and buckle 11*b*, as a typical fastening mechanism, shown in the fastened state as 11 in FIG. 5.

It is within the scope of the invention to make variations and modifications and substitution of equivalents, to the extent that would be obvious to an ordinary artisan skilled in this particular field.

Note that the case tends to "lean-outwardly" if and when the horizontal circumscribing cord is not above the mid-height point; according, by being above the approximate mid-height point previously described, the attache case when carried by the shoulder strap over the person's shoulder, tends to hang properly uprightly, without tipping.

Also, the height of the circumscribing horizontal cord must not be so high as to permit it to accidentally slip-upwardly and over the top of the hand luggage supported thereby.

Note that while adjustable cord lengths are preferred, stationary sewed or rivited interconnections of vertical ends and the circumscribing horizontal cord are contemplated.

I claim:

1. A luggage-harness device comprising in combination: an elongated shoulder strap means for carrying a luggage harness; two latching means each for securing spaced-apart positions of a baggage harness to opposite ends of the shoulder strap means; and a harness means for enveloping sides and a bottom of a cuboid-shaped hand luggage, consisting of a horizontal circumscribing cord and a detachable fastening means for intermittently fastening together opposite ends of the horizontal circumscribing cord, the harness means further consisting of a bottom cord including opposite vertical ends adapted to support opposite ends of a cuboid-shaped hand luggage and a horizontal bottom section in series with and intermediate between and continuous with said opposite vertical ends, the horizontal bottom section being adapted to support and to extend along a longitudinal axis of a bottom of a cuboid-shaped hand luggage, each of said opposite vertical ends extending upwardly to and above an immovable connection means which adjustably fastens each said opposite vertical ends between the horizontal circumscribing cord at each of opposite spaced-apart ends of the horizontal circumscribing cord by which the horizontal circumscribing cord is anchored against slipping upwardly and over a top of a cuboid-shaped hand luggage when carried within the horizontal circumscribing cord but which the horizontal circumscribing cord may selectively be adjusted horizontally or vertically by the connection means, with a center of gravity of the harness means substantially equally-spaced between said opposite spaced-apart ends and with each said immovable connection means being at an elevation point with a center of gravity below the horizontal-circumscribing cord for and when a cuboid-shaped hand luggage is mounted therein whereby accidental tipping thereof is deterred and whereby steady-carriage thereof is maintained during the transporting of a cuboid-shaped hand luggage within the harness means when the elongated shoulder strap means is supported on a person's shoulder.

2. A luggage-harness device of claim 1, in which each of said opposite vertical ends extends a predetermined distance above each said immovable connection means sufficiently for a central upper edge of a supported cuboid-shaped hand luggage having an upper luggage edge above said horizontal circumscribing cord to have free access an upper-edge handle of a cuboid-shaped hand luggage carried within said harness means.

3. A luggage-harness device of claim 2, in which each of said opposite vertical ends are of predetermined lengths sufficiently long such that said latching means is normally positioned adequately above an upper edge of a supported hand luggage as to avoid scarring of an upper edge of supported hand luggage.

4. A luggage-harness device of claim 2, in which said two latching means attach upper ends of the opposite vertical ends to said elongated shoulder strap means at opposite spaced-apart ends of the elongated shoulder strap means, and in which said two latching means each are attached to the opposite vertical ends at said predetermined distance above each said immovable connection means whereby the latching means are normally positioned adequately above an upper edge of a supported cuboid-shaped hand luggage as to avoid scarring of an upper edge of the luggage.

* * * * *